US005743455A

United States Patent [19]

Holliday

[11] Patent Number: 5,743,455

[45] Date of Patent: Apr. 28, 1998

[54] ADAPTER FOR FASTENER DRIVING TOOL AND METHOD THEREOF

[76] Inventor: Brett Holliday, Turkhill Rd., Brewster, N.Y. 10509

[21] Appl. No.: 668,548

[22] Filed: Jun. 21, 1996

[51] Int. Cl.[6] ..... B25C 7/00

[52] U.S. Cl. ..... 227/142; 227/119; 227/156

[58] Field of Search ..... 227/8, 119, 142, 227/156, 19

[56] References Cited

U.S. PATENT DOCUMENTS

| | | | |
|---|---|---|---|
| 1,997,438 | 4/1935 | Stimpson et al. | 227/119 |
| 3,074,719 | 1/1963 | McKee | 227/142 |
| 3,750,925 | 8/1973 | Schmidt et al. | 227/119 |
| 4,327,485 | 5/1982 | Rix | 227/142 |
| 4,444,348 | 4/1984 | Campbell, Jr. | 227/149 |
| 4,577,794 | 3/1986 | Armstrong et al. | 227/119 |
| 4,731,917 | 3/1988 | Krowl | 29/432 |
| 4,767,043 | 8/1988 | Canlas, Jr. | 227/8 |
| 4,789,090 | 12/1988 | Blake, III | 227/19 |
| 4,821,937 | 4/1989 | Rafferty | 227/8 |
| 4,919,320 | 4/1990 | Storace | 227/19 |
| 4,928,867 | 5/1990 | Jensen | 227/156 |
| 5,174,487 | 12/1992 | Rothfuss et al. | 227/19 |
| 5,201,449 | 4/1993 | Miller | 227/8 |
| 5,219,110 | 6/1993 | Mukoyama | 227/8 |
| 5,238,167 | 8/1993 | Howard et al. | 227/110 |
| 5,263,626 | 11/1993 | Howard et al. | 227/8 |
| 5,263,842 | 11/1993 | Fealey | 227/8 |
| 5,385,286 | 1/1995 | Johnson, Jr. | 227/8 |
| 5,405,071 | 4/1995 | Baugus | 227/140 |
| 5,452,835 | 9/1995 | Shkolnikov | 227/8 |

*Primary Examiner*—Joseph J. Hail, III
*Assistant Examiner*—Jay A. Stelacone
*Attorney, Agent, or Firm*—Robin, Blecker & Daley

[57] ABSTRACT

An adapter for a fastener driving tool for controlling depth penetration of a fastener fired from the tool, comprising a lip portion adapted for attachment to a firing portion of the fastener driving tool and extending downward from the firing portion and substantially across to form a recess. The recess, in corresponding alignment with the firing portions engages the fastener when the fastener is fired from the fastener driving tool to allow for a spacing between the fastener and material.

13 Claims, 1 Drawing Sheet

ADAPTER FOR FASTENER DRIVING TOOL AND METHOD THEREOF

FIELD OF THE INVENTION

This invention relates generally to fastener driving tools, and in particular, to an adapter for a fastener driving tool which controls depth penetration of a fastener into material.

BACKGROUND OF THE INVENTION

In recent years, application of vinyl siding to the exterior surfaces of buildings has become very popular in that the vinyl siding helps to extend the overall life of the structure of the house. However, in order to install properly vinyl siding to an exterior surface of, for example, a house, each piece of vinyl siding must be carefully positioned and engaging portions of nails, staples or other fastening means must be spaced somewhat above the vinyl siding and cannot be flush with the siding. This spacing is needed because when the vinyl siding is applied to the exterior surface of the house, the siding expands and contracts based upon temperature fluctuation. This spacing thereby allows for the siding to expand and contract as needed.

Since pneumatic tools have also become increasingly popular in the construction industry, pneumatic nail guns, for example, have been developed to address this needed spacing requirement when applying vinyl siding to houses.

One example of a pneumatic nail gun which controls the depth of penetration of a nail ejected from a nail gun is disclosed in U.S. Pat. No. 5,405,071 ("Baugus"). The Baugus patent discloses a pneumatic nail gun with a cylindrical adjustment knob member coupled to a push lever or firing head of the gun which permits for adjustment of the height of the gun relative to a nailing surface. This knob member acts as a spacer between the firing head of the gun and the nailing surface but does not actually control the depth of the nail itself in relation to the nailing surface. This type of spacing of Baugus lends to less accuracy in controlling the height of the nail in relation to the siding since control is not based on regulating the height of the nail itself but rather on how the operator positions the gun with respect to the nailing surface. Further; this knob member does not easily combine or attach to a nail gun, but requires a base member for connection therewith.

Accordingly, other types of devices and mechanisms are being sought for finer and more accurate control and adjustment of fastener placement in relation to a material and which are easily connectable or attachable to pneumatic fastener driving tools.

It is therefore an object of the present invention to provide an adapter for a fastener driving tool which permits for more controlled and accurate depth penetration of fastening means from the tool into a material.

It is an additional object of the present invention to provide an adapter which is easily connectable or attachable to or from a fastener driving tool.

It is a further object of the present invention to provide an adapter which is simple in design and economical to manufacture.

SUMMARY OF THE INVENTION

In accordance with the principles of the present invention, the above and other objectives are realized in an adapter for a fastener driving tool for controlling depth penetration of a fastener fired from the fastener driving tool, which comprises a lip portion adapted for attachment to a firing portion of the fastener driving tool and extending downward from the firing portion and substantially across to form a recess. The recess, in corresponding alignment with the firing portion, engages the fastener when the fastener is fired from the fastener driving tool to provide a spacing between the fastener and the material.

BRIEF DESCRIPTION OF THE DRAWINGS

The above and other features and aspects of the present invention will become more apparent upon reading the following detailed description in conjunction with the accompanying drawings, in which.

DETAILED DESCRIPTION

Figure 1:
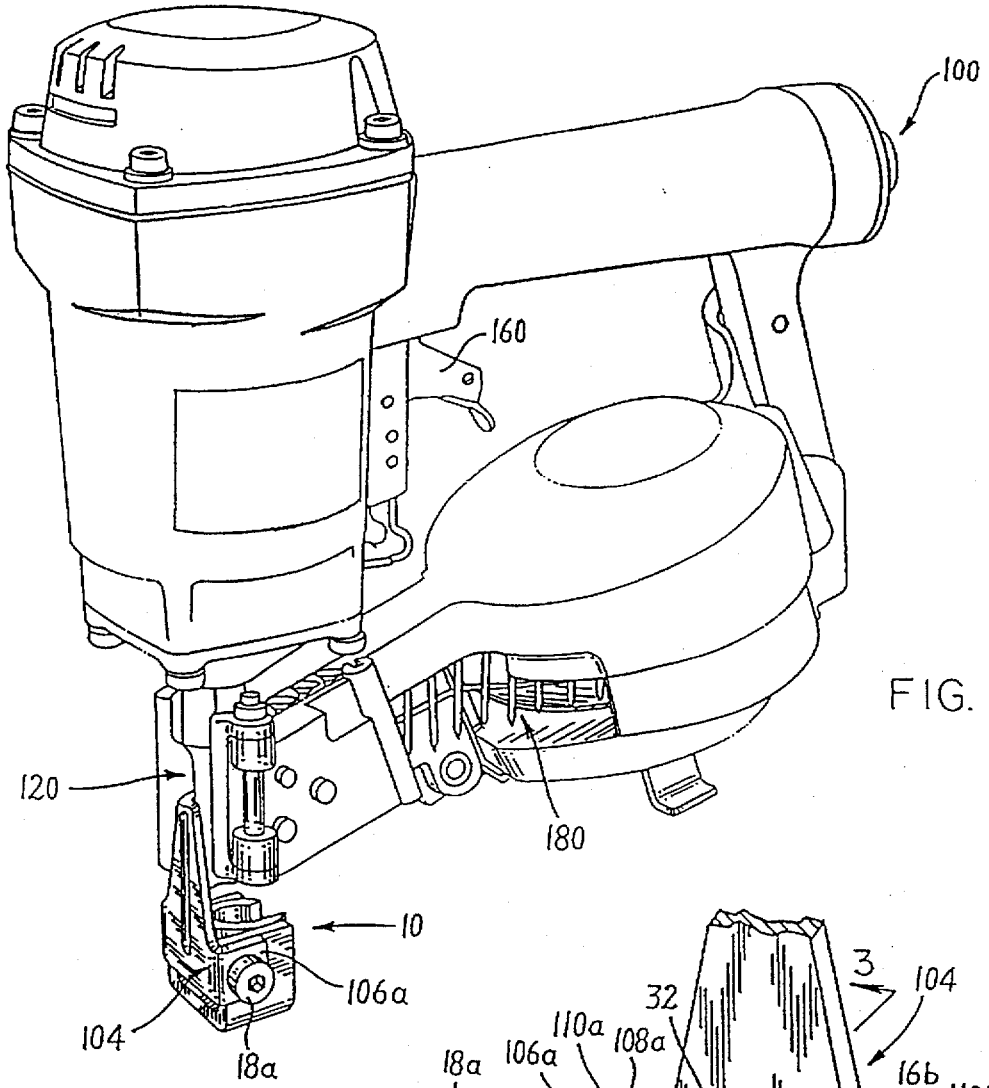
FIG. 1 shows a perspective view of an adapter in accordance with the principles of the present invention connected to a pneumatic nail gun.
Figure 2:
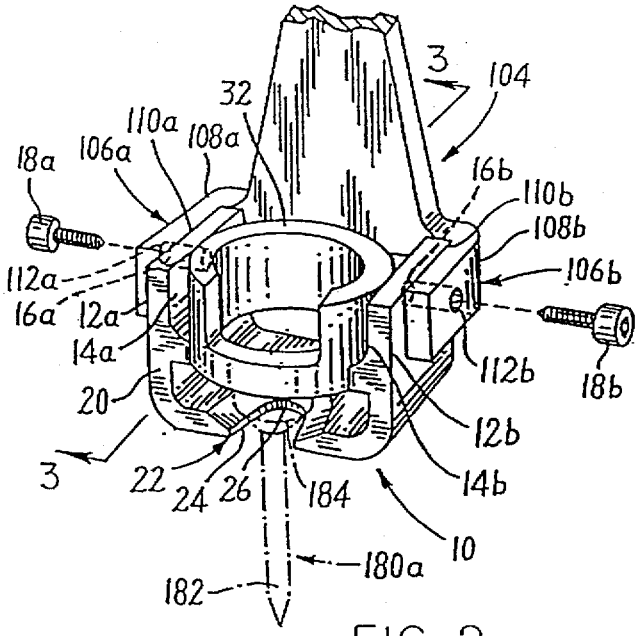
FIG. 2 shows an enlarged perspective view of the adapter of the present invention of FIG. 1.
Figure 3:
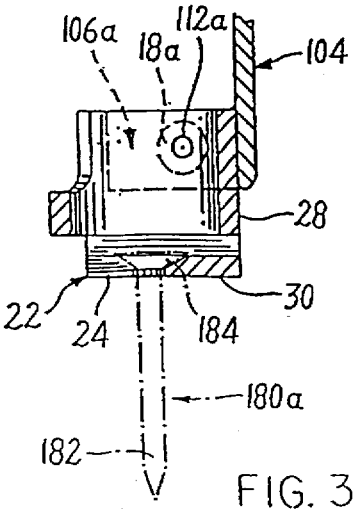
FIG. 3 shows a cross-sectional view of the adapter along the lines 3—3 of FIG. 2.

FIGS. 1–3 show an adapter 10 in accordance with the principles of the present invention connected to a fastener driving tool or pneumatic nail gun 100. In the present invention, the adapter 10 attached to the pneumatic nail gun 100 controls the depth to which fastening means or fastener, for example, a nail, can be driven into material, such as vinyl siding, from the gun 100 thereby allowing for a desired spacing between the nail and the vinyl siding.

In the present illustrative embodiment of FIGS. 1–3, the adapter 10 comprises a lip portion 20, which is L-shaped having upper and lower portions 28 and 30. As shown in FIG. 1 partially cut-away, the lip portion 20 is adapted for attachment to push means or trip lever 104. The trip lever 104 partially surrounds the firing head of the gun 100 and is attached to a firing portion or area 120 of the gun 100 where nails 180 enter into and are ejected or fired therefrom. The trip lever 104 functions as a safety device for the gun 100 by restricting the gun 100 to fire only when the lever 104 is pressed against a nailing surface and does not enable the gun 100 to fire if the trigger 160 is pulled and the lever 104 has not been pressed.

As illustrated in FIG. 2, the lip portion 20 extends downward from the trip lever 104 of the firing portion 120 and substantially across to form a recess 22. The recess 22, in corresponding alignment with the firing portion 120, engages a nail 180*a* when the nail 180*a* is fired from the firing portion 120 of the gun 100 to control depth penetration of the nail 180*a* into the vinyl siding.

The recess 22 is formed in the lip portion 20 to allow a piercing portion or point 182 of the nail 180*a* fired from the gun 100 to pass through the recess 22 as well as to engage an engaging portion or head 184 of the nail 180*a*. The recess 22 is a slightly flared U-shaped configuration with a partial circular portion 26 of the recess 22 being adapted for engaging the head 184 of the nail 180*a*.

Particularly, edges 24 of the recess 22 engage the head 184 of the nail 180*a* at the partial circular portion 26 and slope slightly downward from the portion 26. The edges 24 are also beveled and machine hardened. Thus the edges 24 of the recess 22 permit for engagement of the head 184 of the nail 180*a* to allow for spacing between the head 184 and the surface of the vinyl siding as well as to prevent the nail head 184 from being flush with the siding. In addition, the flared U-shaped configuration of the recess 22 and the downwardly sloping edges 24 permit for the head 184 to be releasable therefrom and enables the operator to then be able to position the gun 100 to fire another nail into the siding.

As more fully illustrated in FIGS. 2 and 3, the adapter 10 is positioned between trip lever arms 106*a* and 106*b* of the trip lever 104. The trip lever arms 106*a* and 106*b* have front and back trip lever surfaces 108*a* and 110*a*, 108*b* and 110*b*, respectively, and centrally located apertures or holes 112*a* and 112*b*, respectively. The apertures 112*a* and 112*b* extend through the trip lever arms from the front trip lever surfaces to the back trip lever surfaces, respectively. The upper portion 28 of the adapter 10 has front and back adapter surfaces 12*a* and 14*a*, 12*b* and 14*b*, respectively, and centrally located recesses 16*a* and 16*b* which extend from the front adapter surfaces toward the back adapter surfaces, respectively. Attaching means or screws 18*a* and 18*b* are positioned in the apertures 112*a* and 112*b*, respectively, and extend through the apertures 112*a* and 112*b* of the trip lever arms 106*a* and 106*b*, respectively, and are positioned in the centrally located recesses 16*a* and 16*b*, respectively, of the adapter 10.

Also as illustrated in FIG. 2, the adapter 10 further comprises a cylindrical portion 32 which is supported by the upper portion 28 of the lip portion 20 which provides for alignment and engagement of the adapter 10 with the firing portion 120 of the gun 100. The cylindrical portion 32 also provides for further directional alignment of the nail 180*a* being fired from the gun 100.

In the present illustrative embodiment, the adapter 10 connected or attached to the trip lever 104 of the gun 100 is positioned on a piece of material, such a piece of vinyl siding. The gun 100 holds a plurality of nails 180 which are positioned to be emitted or ejected therefrom through the firing portion 120 of the gun 100. With the adapter 10 so positioned, the operator then pulls the trigger 160 on the gun 100 to allow a nail 180*a* to be positioned in the gun 100 and pushes downward on the trip lever 104 to permit release of the nail 180*a*. The operator can also press the trip lever 104 against the nailing surface and then pull the gun trigger 160 to also permit release of the nail 180*a*.

In the present embodiment, the adapter 10 can space a nail approximately 2 millimeters to 4 millimeters away from the surface of the vinyl siding. However, this range is extremely variable depending upon the type of material in which a nail must be inserted into, the type of gun to which the adapter has been attached to, the type of nail or fastening means being used, etc.

In the present illustrative embodiment of FIG. 1, the pneumatic nail gun 100 is a Stanley®-Bostitch N12B series coil-fed pneumatic hailer commercially available from Stanley Fastening Systems located in East Greenwich, Rhode Island, however, any type of fastener driving tool can be used.

The adapter 10 of the present invention is also not limited to the above configurations but can be a variety of different sizes depending on its use. In addition, the adapter 10 is not limited to being attachable or connectable to the gun 100 but can be a part of the gun 100 itself. Further, the adapter 10 and trip lever 104 can be formed as several separate parts engaging one another or as one single part.

Additionally, the recess 22 is also not limited to its present configuration but can be any shape or size which permits for engaging a portion of fastening means to provide spacing between the portion of fastening means and a material. In addition, the edges 24 of the recess 22 can be smoothed; grooved, etc., to assist in engagement of fastening means. Also the adapter 10 is not limited to use with vinyl siding, but can be used with any type of material which requires application of spacing between a portion of fastening means and the material. Attaching means is also not limited to the above embodiment but can comprise any type of means, such as pins, grooves, adhesive, threaded engagement, or any other fastening or connecting means which can be used to assemble, hold and/or connect the adapter 10 and trip lever 104. In addition, the adapter 10 is also not limited to attachment to the trip lever 104 as illustrated, but can be attached to the trip lever 104 at a variety of different locations depending upon the type of trip lever being used.

In all cases it is understood that the above-described arrangements are merely illustrative of the many possible specific embodiments which represent applications of the present invention. Numerous and varied other arrangements, can be readily devised in accordance with the principles of the present invention without departing from the spirit and scope of the invention.

What is claimed is:

1. An adapter for a fastener driving tool for controlling depth penetration of fastening means fired from the fastener driving tool, comprising:

a lip portion adapted for attachment to a firing portion of the fastener driving tool, said lip portion extending downward from the firing portion and substantially across the width of said firing portion, said lip portion having front and back sides and a recess extending from the front side of the lip portion toward the back side of the lip portion, said recess being U-shaped to allow for a piercing portion of said fastening means to pass through the recess and having edges to allow for engagement of an engaging portion of said fastening means when said fastening means is fired from the fastener driving tool.

2. An adapter in accordance with claim 1, wherein said recess is a slightly flared U-shape.

3. An adapter in accordance with claim 2, wherein said edges are beveled and machine hardened.

4. An adapter in accordance with claim 3, wherein said lip portion is L-shaped having an upper portion and a lower portion.

5. A fastener driving tool for controlling depth penetration of fastening means, comprising:

a body for storing said fastening means and having a firing portion for permitting firing of said fastening means from the tool; and an adapter comprising a lip portion adapted for attachment to the firing portion of the tool, said lip portion extending downward from the firing portion and substantially across the width of said firing portion, said lip portion having front and back sides and a recess extending from the front side of the lip portion toward the back side of the lip portion, said recess being U-shaped to allow for a piercing portion of said fastening means to pass through the recess and having edges to allow for engagement of an engaging portion of said fastening means when said fastening means is fired from the fastener driving tool.

6. A fastener driving tool in accordance with claim 5, wherein said recess is a slightly flared U-shape.

7. A fastener driving tool in accordance with claim 6, wherein said edges are beveled and machine hardened.

8. A fastener driving tool in accordance with claim 7, wherein said fastening means comprises a nail, said piercing portion is a point of the nail and said engaging portion is a head of the nail.

9. A fastener driving tool in accordance with claim 8, wherein said lip portion is L-shaped having an upper portion and a lower portion.

10. A fastener driving tool in accordance with claim 9, wherein said fastener driving tool further comprises push means adapted for attachment to the firing portion for allowing the tool to fire said nail when an operator pushes the push means downward.

11. A fastener driving tool in accordance with claim 10, wherein said upper portion of said lip portion is adapted for attachment to said push means.

12. A method for controlling depth penetration of fastening means fired from a fastener driving tool, comprising the steps of:

attaching an adapter to a firing portion of the fastener driving tool, said adapter comprising a lip portion extending downward from the firing portion and substantially across the width of said firing portion, said lip portion having a U-shaped recess extending from the front side of the lip portion toward the back side of the lip portion;

triggering said fastener driving tool to fire said fastening means; and passing a piercing portion of said fastening means through the recess of the lip portion and engaging an engaging portion of said fastening means by an edge portion of the recess of the lip portion when said fastening means is fired from the fastener driving tool.

13. A method in accordance with claim 12, wherein said triggering step further comprises the step of:

pushing downward push means adapted for attachment to the firing portion to permit the tool to fire said fastening means.

* * * * *